US005102502A

United States Patent [19]

Reinhardt et al.

[11] Patent Number: 5,102,502

[45] Date of Patent: Apr. 7, 1992

[54] MANUFACTURE OF HIGHLY COMPRESSED PAPER CONTAINING SYNTHETIC FIBERS

[75] Inventors: Bernd Reinhardt, Osnabrück; Leif Frilund, Kouvola; Volker Viehmeyer, Osnabrück, all of Fed. Rep. of Germany

[73] Assignee: Kammerer GmbH, Osnabrück, Fed. Rep. of Germany

[21] Appl. No.: 538,024

[22] Filed: Jun. 13, 1990

[30] Foreign Application Priority Data

Jun. 16, 1989 [EP] European Pat. Off. ..... 89110944.9

[51] Int. Cl.[5] ..... D21H 25/06

[52] U.S. Cl. ..... 162/135; 162/136; 162/146; 162/168.1; 162/177; 162/206

[58] Field of Search ..... 162/146, 206, 157.5, 162/177, 135, 136, 168.1, 205

[56] References Cited

U.S. PATENT DOCUMENTS

| | | | |
|---|---|---|---|
| 3,415,671 | 12/1968 | Rice | 117/64 |
| 4,015,043 | 3/1977 | Watanabe et al. | 162/146 |
| 4,216,055 | 8/1980 | Watanabe et al. | 162/146 |
| 4,257,843 | 3/1981 | Watanabe et al. | 162/146 |
| 4,308,542 | 12/1981 | Maekawa et al. | 162/146 |
| 4,496,427 | 1/1985 | Davison | 162/157.5 |
| 4,927,495 | 5/1990 | Tamagawa | 162/206 |

FOREIGN PATENT DOCUMENTS

| | | | |
|---|---|---|---|
| 825755 | 4/1981 | U.S.S.R. | 162/177 |

OTHER PUBLICATIONS

Paper and Board Manufacture, ABIPC vol. 45 (Feb. 1975), Abstract No. 8130, I. I. Mazanova et al., "Manufacture of Cable Paper With the Use of Synthetic Fibers".

*Primary Examiner*—Peter Chin

*Attorney, Agent, or Firm*—Lockwood, Alex, FitzGibbon & Cummings

[57] ABSTRACT

A process for the manufacture of highly compressed paper containing synthetic fibers with a volume weight of equal to or greater than 0.9 kg/dm$^3$ whereby the paper sheet which comprises a mixture of cellulose and thermoplastic synthetic fibers in the ratio of 50:50 to 90:10 with a degree of grinding of 35 to 75 SR, is treated with sizing, retention and wetting agents and, if applicable, filler materials and is sized on the surface. Subsequently during a separate operational stage the sheet is subjected to a glaze finishing at surface temperatures of the calender rollers of equal to or greater than 100° C. and linear roller pressures equal to or greater than 30 Kn/m.

23 Claims, No Drawings

MANUFACTURE OF HIGHLY COMPRESSED PAPER CONTAINING SYNTHETIC FIBERS

BACKGROUND AND DESCRIPTION OF THE INVENTION

The invention relates to a process for the production of highly compressed paper sheets comprising celluloses with the addition of thermoplastic synthetic fibers with a volume weight ≧ 0.9 kg/dm$^3$, as well as the use of the same.

It is already known to manufacture laminar structures through the partial or complete use of thermoplastic synthetic fibers. Through the addition of synthetic fibers to the cellulose, for example, modifications in the strength characteristics or in the surface properties of the laminar materials, designated in the following as the paper sheet or paper in the broader sense, are sought as the objective.

Polyamide, polyethylene, polyester or polypropylene fibers, for example, the melting temperatures of which frequently are more or less distinctly above the surface temperatures (convection, IR, other contact-free drying processes) of approximately 85° C. to 130° C. which are usual in the manufacture of paper, are of consideration as synthetic fibers. They often represent only one type of reinforcing or support material with a strength improving effect in the formed cellulose sheet, but then do not bond irreversibly through thermal diffusion with the cellulose fibers at the intersecting points.

It is known from the manufacture of non-woven fabrics, for example, that this laminar structure results from loose fiber through thermal hardening treatment or precise thermo diffusion by means of so called binding fibers. The fiber which forms the nonwoven fabric is thereby designated as the support fiber, and the melting component is designated as the binding fiber. These binding fibers are divided into the 3 primary groups:

Adhesion fibers;

Bicomponent fibers; and

Thermoplastic adhesive fibers.

Adhesion fibers, for example, are non-stretched, amorphous polyester fibers, which soften on the surface at barely 100° C., and thereby become sticky and capable of bonding. A complete calendaring is necessary for this. The necessary proportion of these very expensive adhesive fibers to the total portion of fibers is relatively high so that their purpose of application is limited, for example, to non-woven fiber materials or electrical insulation.

The most elegant solution for the thermal hardening is attained with the bicomponent fiber (mostly core-casing fibers with low-melting casing polymer as the adhesive component). In order to attain an adequate thermofusion with other fibers, however, high additions of these bicomponent fibers are necessary. The use of these is therefore only justified in the manufacture of nonwoven fiber material of the highest valve.

On the other hand, many practical cases of application and areas of use can be covered by means of thermoplastic adhesive fibers. In principle, every thermoplastic fiber with a melting range from approximately 100° C can be used as a thermoplastic adhesive fiber. The ideal thermoplastic adhesive fiber should first begin to soften and deform before reaching the melting temperature. Depending on the type of thermoplastic fibers which are used, the melting temperature generally lies between:

123° C. in the case of LLDPE (linear low density polyethylene) fibers;

132° C. in the case of HDPE (high-density polyethylene) fibers;

120–140° C. in the case of copolyamide fibers;

145–175° C. in the case of copolyester fibers;

215–218° C. in the case of polyamide fibers;

245–260° C. in the case of polyester fibers; and

160° C. in the case of acrylic fibers (copolymers of acrylonitrile and methyl methacrylate).

Under the supposition that an addition of thermoplastic synthetic fibers to conventional cellulose fibers, even during the production or finishing of the paper (for example, off-line glaze finishing), and the temperatures which thereby arise, should lead through thermofusion to irreversible contacts at the intersecting points between the natural cellulose and the synthetic thermoplastic adhesive fibers, the multiplicity of types of usable thermoplastic adhesive fibers is reduced to such as have a crystal melting point below 200° C, preferably below 150° C. It is thereby assumed that the softening range of these thermoplastic synthetic fibers is generally lower for example, with PE-homopolymers (HDPE) it is from 95° C., and in the case of PE-copolymers (LLDPE) it is from 72° C.

The use of synthetic fibers during the production of special papers is already known from the patent and specialized technical literature. The first of these involve, for example, oriented polyethylene fibers which are used for the substitution of asbestos in reinforced cement, resin or floor materials (EP 0292 285 Al), and multiple-layer structures with one or more layers of synthetic fibers (polyethylene terephthalate-copolymer with cellulose with melting points of 110° C), combined with cellulose sheets for agricultural products (EP 0255 690 AI), or combinations of vegetable fibers (wood chips, among others) and polyolefins (polypropylene), which are deformed into foil-like materials by means of hot calendering at temperatures of between !72 and I90° C. In this, value is always placed on the most voluminous possible surface structure with opacity which is thereby higher.

Indications are likewise to be drawn from the specialized technical literature regarding the partial addition of synthetic fibers to the cellulose, such as for example, the use of polymer powders of unstated chemical composition for the production of washable wallpapers of the highest possible porosity and opacity, whereby the laminar structure has also been subjected to a hot calendering (Cellulose Chemistry and Technology [198I], number 15, pages 125–132).

In another technical publication (Paper Technology and Industry [1979], number ½, pages 32-34), the addition of up to 70% synthetic fibers of polyethylene ("Hostapulp" by Hoechst) in a layer is recommended for the production of two-layer imprinted or peelable wallpapers of 150 g/m, The fusion of the synthetic fibers with the cellulose is carried out by supplying hot air (135-170° ) and/or by means of hot calendering (140° C.). Through this means, too, the highest possible opacity is additionally sought.

The use of u to 100% polyethylene fibers in the two covering layers of three-layer laminar composite paper structures, as well as the fusion of these by means of irradiation heat (IR preheating up to 37–54° C. sheet temperature), and the subsequent glaze finishing at ambient temperature, is described in the journal Tappi (1985), number 7, pages 94–97.

The goal of the invention was the development of multiple layer laminar paper sheets from polyethylene and cellulose as an alternative to paper sheets with good barrier characteristics which are laminated with polyethylene foil or extruded polyethylene. The maintenance of the high level of opacity of these triplex papers which has been sought, but which had more or less decreased because of the selected conditions of the thermofusion, presented difficulties. Such triplex papers with polyethylene cover layers are recommended as alternatives for the known polyethylene layered papers (which are mostly polyethylene-extruded), and also as detachable backing papers, among others.

The addition of up to 20% synthetic fibers from polyolefins (polyethylene, polypropylene) to the cellulose in order to attain both high opacities and good printing characteristics after the coating of the sheet with combinations of pigment bonding agent, is recommended in Tappi (1985), number 10, pages 91–93.

The influence of a moist-hot glaze finishing on paper sheets with the addition of synthetic fibers is discussed in Paper Technology and Industry (1975), number 10, pages 309–312. The addition of HDPE fibers to the cellulose thereby amounted to between 0 and 90%.

It was the goal of the latter invention to find in papers with addition of synthetic fiber and within a range of the surface-covered mass of 50–60 g/m$^2$, glaze finishing conditions which provided both high volume (slight volume weight) and high opacity along with simultaneously improved smoothness to the paper. It was found that the improvement of the smoothness was proportional to the increase of the volume weight. Because papers with an addition of synthetic fibers have a higher density than pure cellulose papers, it was possible to achieve increases in smoothness with simultaneously high paper volume and good opacity by means of moist-hot glaze finishing (20–80° C., 3–9% moisture before the glaze finishing, 35–350 kN/m pressure).

Upon attaining the so-called critical density (volume weight) of the paper of 60 g/m$^3$ which, depending on the portion of synthetic fiber which lies between 0.6 kg/dm$^3$ (90% synthetic fibers) and $<$0.9 kg/dm$^3$ (0% synthetic fiber), there resulted an undesirable dramatic reduction in the opacity and an increasing blackening of the paper surface which was connected with the formation of transparent spots when using steel-to-rubber rollers. The authors therefore recommend calendering conditions which only effect a compression below the critical paper density. With a 20% synthetic fiber portion in the paper (60 g/m,) for example, the critical paper density of $<$0.8 kg/dm$^3$ would be surpassed by means of steel-to-rubber rollers. On the other hand, however, a steam moistening of the paper (superficial application of water) makes high surface smoothness possible, with minimal loss of opacity. In the technical information sheets of the manufacturer of polyethylene fibers, a critical density of the papers of 0.65 kg/dm$^3$ (steel/steel) or 0.70 kg/dm$^3$ (cotton/steel rollers) is stated. Under such types of optimized calendering conditions on the large-scale technical level, opacities of approximately 88% at 60 g/m$^3$ paper (surface-pigmented) were obtained.

The task which forms the basis of the invention is, on the other hand, that of creating a foil-like material from cellulose and synthetic fibers which has a gross density equal to or greater than the critical range, that is to say 0.9 kg/dm$^2$, and thereby a transparency of 35%. The transparency is necessary because a control of the photocells in the technical processing processes thereby becomes possible, for example, in labelling processes. This task is resolved by means of the process measures stated in the claims, as well as by the applications stated.

The sheet material may also include sizing, retention and wetting agents and fillers.

In contrast with the highly compressed silicon backing papers which were previously known, the paper in accordance with the invention has better tightness against solvents, higher dimensional stability, lower water absorption relative to the influence of moisture, lower porosity, and greater smoothness/lower microcoarseness. With the addition of synthetic fiber, the paper in accordance with the invention occupies in terms of its characteristics a middle position between a classical silicon backing paper of 100% cellulose and the foils of polyethylene (LLPE or HDPE), polyester, oriented polypropylene or polystyrol likewise used for the silicon coating. Although foils are more expensive than papers, they are preferred and used specifically where high transparency, toughness, barrier characteristics or heat-sealing capabilities are desired. Furthermore, because of their closed surface, foils now require smaller application quantities of silicon resins of approximately 50% in order to attain the same level of separation force as siliconized papers.

The papers in accordance with the invention with the addition of synthetic fibers to the polyethylene basis has along with a lesser need for silicon, better rigidity, and above all, higher temperature resistance in comparison with foils. It is precisely that the drying temperature after silicon coating is limited by the possible thermal deformation in the case of polyethylene foils as well as foils of polyester and polypropylene.

During the silicon coating of paper, drying temperatures between I50 and 220° C are conventional. In the case of foil coatings, drying temperatures which are approximately 30–50% lower, and thus the hardening time must be taken into account as well. The manufacture and the characteristics of the transparent paper in accordance with the invention with the addition of synthetic fiber onto polyethylene base will be illustrated in greater detail in the following examples of execution.

EXAMPLE 1

In the laboratory refiner (Escher Wyss type) mixtures of 40% bleached long and short fiber sulfate cellulose (pine and birch cellulose), as well as 20% synthetic fibers of different type were ground together up to a degree of grinding of 50 SR. The manufacture of paper sheets with a mass-covered surface of 70±4 g/m$^2$ was subsequently carried out on a laboratory paper machine (Kammerer type) with addition of resin glue (computed at 0.5%) and Al-sulfate (pH of 4.5 of the materials mixture). The surface temperatures of the drying cylinders were 80 to 105° C.

The cellulose composition of the comparison sample (base sample) also pulverized to 50 SR, comprised 50% bleached long and short fiber sulfate cellulose of the same cellulose type as before, and was based on the classical raw materials recipe for highly compressed separable backing papers.

In order to be able to better determine the foil-like character of the papers containing synthetic fiber, in every series of experiments a portion of the paper sheet was sized on the surface by means of a laboratory sizing press (Mathis type). The 3.5% sizing solution comprised 80% of polyvinyl alcohol and 20% carboxymethyl cellulose.

The papers thus produced were subsequently glaze finished under various conditions which were close to normally practiced conditions, with constant linear pressure of 2500 daN (corresponds to >350 kN/m during the actual glaze finishing) in a two-roller steel-to-cotton roller calender:

(1) Dry glaze finishing (without pre-moistening moisture of the sheet 4.5%, at:
   a) 110° C. surface temperature of the steel roller;
   b) 140° C. surface temperature of the steel roller.
(2) Moist glaze finishing (with pre-moistening by means of the nozzle moistener, sheet moisture approximately 15%) at:
   a) 110° C. surface temperature of the steel roller;
   b) 140° surface temperature of the steel roller.

The 6 different synthetic fibers were partially different from the chemical viewpoint (See Table 0).

It was possible, of course, to grind the Dow products without problems together with the celluloses. However, since this led to sharp irregularities on the surface during the manufacture of the paper, these could not be glaze-finished so they were eliminated from the further comparative considerations.

The characteristics of the differently glazed papers are shown in Table I (characteristics of the backing papers); Table 2 (papers without surface sizing, dry glaze finished at two different roller temperatures); Table 3 (papers without surface sizing, moist glaze finished at two different roller temperatures); Table 4 (paper with surface sizing, dry glaze finished at two different roller temperatures) and Table 5 (papers with surface sizing, moist glaze finished at two different roller temperatures).

Both during moist as well as during dry glaze finishing, the volume weight of the paper was raised from 0.50 -0.68 kg/dm$^3$ (See Table I) to 0.84–1.12 kg/dm$^3$, and the "critical density" for the reduction of opacity was thereby exceeded by a larger amount for a period.

While the transparency values of the backing papers in accordance with Table are below 20–30%, through the glaze finishing the transparencies of ≧35% which were the object of the invention were exceeded by a large extent.

Above all, a moist glaze finishing at roller temperatures of 140° C yielded high transparency values (See Tables 3 and 5), which are partly at the level of the base samples. This applies, in particular, for sample numbers 2, 4 and 5. In comparison with the base sample, considerable quality improvements were achieved in regard to solvent density (identified as Cobb-Risinus value and IGT-spot length) on the dense side (DS), wet strength, porosity, dimensional stability and surface smoothness. However, at the same time with this strong compression and high thermofusion, a reduction in the strength of the papers containing synthetic fibers relative to the base sample must be taken into account. The bonding forces of the cellulose (hydrogen bridge bonds) were presumably replaced in part by the less effective bonding forces at the intersecting points of the various fiber materials (thermoplastic adhesion).

The foil-like character of the paper is achieved above all through the use of the polyethylene fibers E-790 and UL-410 made by Matsui. There are involved in this case HDPE or LLDPE fibers which are hydrophilically equipped with polyvinyl alcohol. (See Das Papier [1982], number 10A, pages V25 to V31), and which find application, among others, during the manufacture of such special papers as tea bags, wallpaper backing and sterilization papers, as well as PVC support materials.

Polyethylene fibers are very well suited for the highly compressed transparent paper with the addition of synthetic fiber in accordance with the invention.

EXAMPLE 2

In accordance with Example 1, papers with 20% addition of synthetic fiber were produced and sized on the surface with a laboratory paper machine in a manner analogous to sample numbers 4 and 5.

The glaze finishing of the paper sheet pre-moistened to approximately 15% was carried out at a constant pressure of 2500 daN. In contrast to the glaze finishing in accordance with example 1, after a moist glaze finishing at 140° C. roller temperature and a storage period of 24 hours, the glaze finished paper was subjected to a dry glaze finishing at 200° C roller temperatures. The paper characteristics obtained (volume weight ≧0.9 kg/dm$^3$) are shown in Table 6.

Because of the dry glaze finishing in the second process stage, the softening temperature of the added polyethylene fibers are exceeded to a large extent. In comparison with the single moist glaze finishing of Example 1, the surface smoothness is thereby reduced, presumably through incipient interlocking (partial cracking) at the contact points of the steel roller/paper.

The solvent tightness and porosity of the highly compressed, transparent detachable backing papers can, however, be improved through a combined moist/dry glaze finishing.

EXAMPLE 3

In contrast with the process in accordance with Example 1, 10% (on the basis of solids) of carboxylated polyethylene fibers of different fiber length (2.8 dtex —4 or 6 mm) were subsequently added to a cellulose mixture of 50% bleached long and short fiber celluloses which had been ground to approximately 50–55 SR. The additional finishing steps on the paper sheets of approximately 70 g/m$^2$ (surface sizing, glaze-finishing) which were formed were carried out in a manner analogous to Examples 1 and 2. The result of the papers with a volume weight of ≧0.9 kg/dm$^3$ which were obtained are shown in Table 7.

Through the moist hot glaze finishing of the paper containing the synthetic fiber, the transparency and smoothness relative to a dry glaze finishing can still be considerably increased while the porosity is reduced. In comparison with the base sample (conventionally produced, highly compressed separable backing paper), the addition of I0% of these carboxylated polyethylene fibers, produces partial improvements in transparency, solvent density, dimensional stability, wet strength, flexibility (elasticity and expansion) and smoothness. This is particularly true in the use of synthetic fibers with a fiber length of 4 mm.

The highly compressed separable backing papers of foillike character stated in Examples I to 3 with a volume weight of ≧0.9 kg/dm$^3$ produced in accordance with the invention, have the positive characteristics of pure cellulose papers and classical plastic foils, such as have previously found application during silicon coating. The addition of synthetic fibers on the polyethylene basis can thereby amount to up to 50%. Higher quantities of additives to the cellulose led to increased interlocking on the heated steel rollers during dry or moist glaze finishing at temperature >100° C. and high roller pressure.

For the improvement of the wetting and adhesion of the silicon resins on the surface of the papers containing synthetic fibers produced in accordance with the invention, there is recommended an electrical surface pretreatment, such as described for example, in the "Allgemeiner Papier-Rundschau" (1988), number 29, pages 794–800, and is conventional in a multiplicity of plastic foils or plastic-coated papers before the silicon coating.

The foil-like papers produced in accordance with the invention are more cost-effective than the classic plastic foils and have a somewhat higher rigidity than them. They are distinguished relative to pure cellulose papers by means of greater flexibility, dimensional stability upon change of moisture and temperature and better sealing characteristics relative to water and solvents. They are, therefore, suited for other applications, such as for example printing and advertising carriers, adhesive bands, covering materials, flexible furniture foil and support paper for other special areas.

The following Tables 0 to 7 illustrate the invention:

TABLE 0

Overview of the Synthetic Fibers Investigated

| Fiber | UL 410 | E 790 | Creslan 93 | Creslan 98 | kN 87/1A | kN 87/1B |
|---|---|---|---|---|---|---|
| Manufacturer | Mitsui | Mitsui | American Cyanamid | American Cyanamid | DOW | DOW |
| Type | Polyethylene | Polyethylene | Copolymer of acrylonitrile and Methyl methacylate | | Polyethylene (carboxylated) | |
| Fiber Length, mm | 0.9 | 1.6 | 5.5–6.0(1) | 5.5–6.0(2) | 6.0 | 10.0 |
| Softening Point, °C. | 123 | 132 | 260 | 260 | not stated | not stated |

(1)1.1 denier, diameter = 12 μm
(2)4.0 denier, diameter = 22 μm

TABLE 1

Characteristics of the Backing Papers

| SAMPLE | Surface Weight g/m² | Thickness, mm | Gross density kg/dm³ | Breaking Load Longitudinal kg | Breaking Load Transverse kg | Expansion Longitudinal % | Expansion Transverse % | Breaking Length Longitudinal km | Breaking Length Transverse km | Elmendorf Longitudinal mN | Elmendorf Transverse mN |
|---|---|---|---|---|---|---|---|---|---|---|---|
| 1 | 71.9 ± 0.23 | 0.105 | 0.684 | 5.6 ± 0.44 | 3.7 ± 0.07 | 5.2 | 4.7 | 5.2 | 3.4 | 480 ± 17 | 511 ± 6 |
| 2 | 67.2 ± 0.12 | 0.123 | 0.352 | 5.6 ± 0.41 | 3.3 ± 0.07 | 5.5 | 3.3 | 5.5 | 3.3 | 507 ± 28 | 585 ± 67 |
| 3 | 69.3 ± 0.34 | 0.129 | 0.537 | 5.5 ± 0.29 | 3.7 ± 0.17 | 5.2 | 3.9 | 5.2 | 3.5 | 543 ± 59 | 549 ± 49 |
| 4 | 73.4 ± 0.29 | 0.124 | 0.592 | 5.3 ± 0.28 | 2.7 ± 0.03 | 4.8 | 5.3 | 4.8 | 2.4 | 422 ± 19 | 419 ± 14 |
| 5 | 71.4 ± 0.16 | 1.122 | 0.585 | 4.9 ± 0.25 | 3.1 ± 0.05 | 4.6 | 4.3 | 4.6 | 2.9 | 373 ± 12 | 434 ± 13 |
| 6 | 73.2 ± 0.24 | 0.147 | 0.498 | 6.3 ± 0.21 | 2.8 ± 0.1 | 5.7 | 5.7 | 5.7 | 2.6 | 416 ± 53 | 394 ± 18 |
| 7 | 73.4 ± 0.60 | 0.145 | 0.506 | 6.3 ± 0.5 | 2.8 ± 0.02 | 5.7 | 4.7 | 5.7 | 2.6 | 420 ± 51 | 543 ± 41 |

| SAMPLE | Bursting Pressure kp/cm² | Wet Strength Longitudinal % | Wet Strength Transverse % | Number of Folds Longitudinal | Number of Folds Transverse | Air Permeability cm³/min | Degree of Whiteness Intermediate % | Degree of Whiteness 5' 180° C. % |
|---|---|---|---|---|---|---|---|---|
| 1 | 1.8 ± 0.11 | 3.9 | 2.8 | 363 ± 80 | 115 ± 23 | 26 ± 2.1 | 77.2 ± 0.1 | 71.7 ± 0.9 |
| 2 | 1.6 ± 0.07 | 1.9 | 3.5 | 375 ± 76 | 102 ± 32 | 43 ± 1 | 74.9 ± 0.1 | 71.2 ± 0.6 |
| 3 | 1.6 ± 0.2 | 1.9 | 4.6 | 163 ± 64 | 64 ± 8 | 50 ± 0 | 78.9 ± 0 | 76.1 ± 0.4 |
| 4 | 1.4 ± 0.2 | 2.4 | — | 198 ± 40 | 23 ± 4 | 32 ± 1 | 83.8 ± 0.1 | 72.2 ± 0.3 |
| 5 | 1.4 ± 0.2 | 2.4 | 1.9 | 172 ± 36 | 29 ± 5 | 24 ± 1 | 83.6 ± 0.0 | 73.2 ± 0.2 |
| 6 | 1.7 ± 0.12 | 1.0 | — | 251 ± 60 | 26 ± 4 | 93 ± 4 | 77.7 ± 0.2 | 72.7 ± 0.3 |
| 7 | 1.8 ± 0.11 | 1.3 | — | 203 ± 25 | 35 ± 9 | 72 ± 7 | 79.3 ± 0.1 | 73.9 ± 0.6 |

Designation of Samples:
1 = base sample
2 = Creslan 98
3 = Creslan 93
4 = UL 410
5 = E 790
6 = kN 87/1 A
7 = kN 87/1 B

TABLE 2

Influence of the Dry Glaze Finishing Paper Without Coating

| SMPL | Surface Weight g/m² | Gross Density kg/dm³ | Elmendorf Longit. mN | Elmendorf Transv. mN | Cobb-Riz. DS g/m² | IGT DS 1000/mm | Air Permeability cm³/min | Transparency % | Smoothness DS Bekk sek |
|---|---|---|---|---|---|---|---|---|---|
| | | | | A. Roller Temperature 110° C. | | | | | |
| 1 | 70.2 ± 0.81 | 1.018 | 338 ± 3 | 375 ± 8 | 7.1 ± 0.13 | 13.8 ± 0.6 | 6.6 ± 0.2 | 37.7 ± 0.7 | 497 ± 89 |
| 2 | 67.9 ± 0.83 | 0.859 | 396 ± 16 | 450 ± 8 | 9.7 ± 0.41 | 16.1 ± 0.2 | 16.0 ± 1.4 | 39.1 ± 0.6 | 104 ± 12 |
| 3 | 68.4 ± 1.08 | 0.854 | 383 ± 3 | 439 ± 51 | 11.4 ± 0.54 | 14.8 ± 0.3 | 18.3 ± 0.2 | 32.9 ± 0.4 | 263 ± 60 |
| 4 | 72.8 ± 0.78 | 1.025 | 338 ± 8 | 393 ± 12 | 4.4 ± 0.08 | 9.7 ± 0.5 | 1.9 ± 0.1 | 33.9 ± 1.1 | 2770 ± 212 |
| 5 | 70.0 ± 1.10 | 1.00 | 340 ± 27 | 408 ± 14 | 5.1 ± 0.03 | 10.1 ± 0.2 | 2.3 ± 0.2 | 35.0 ± 1.6 | 1608 ± 164 |
| | | | | B. Roller Temperature 140° C. | | | | | |
| 1 | 69.8 ± 0.68 | 1.027 | 398 ± 31 | 408 ± 3 | 6.5 ± 0.08 | 11.7 ± 0.2 | 5.9 ± 0.2 | 41.2 ± 0.2 | 767 ± 88 |

TABLE 2-continued

| SMPL | Surface Weight g/m² | Gross Density kg/dm³ | Elmendorf Longit. mN | Elmendorf Transv. mN | Cobb-Riz. DS g/m² | IGT DS 1000/mm | Air Permeability cm³/min | Transparency % | Smoothness DS Bekk sek |
|---|---|---|---|---|---|---|---|---|---|
| | | | Influence of the Dry Glaze Finishing Paper Without Coating | | | | | | |
| 2 | 66.6 ± 0.94 | 0.843 | 365 ± 13 | 404 ± 5 | 9.0 ± 0.07 | 15.0 ± 0.3 | 12.2 ± 0.7 | 42.7 ± 0.7 | 136 ± 19 |
| 3 | 68.7 ± 1.02 | 0.881 | 380 ± 13 | 452 ± 28 | 10.4 ± 0.15 | 14.0 ± 0.4 | 13.9 ± 0.9 | 35.1 ± 0.6 | 260 ± 29 |
| 4 | 72.4 ± 0.99 | 1.006 | 325 ± 0 | 363 ± 4 | 3.9 ± 0.07 | 9.8 ± 0.4 | 1.3 ± 0.1 | 39.3 ± 1.9 | 2674 ± 128 |
| 5 | 70.4 ± 0.60 | 0.978 | 321 ± 4 | 393 ± 13 | 4.5 ± 0.13 | 9.8 ± 0.5 | 1.9 ± 0.2 | 38.1 ± 1.5 | 1820 ± 111 |

Designation of Samples:
1 = base sample
2 = Creslan 98
3 = Creslan 93
4 = UL 410
5 = E 790

TABLE 3

| SMPL | Surface Weight g/m² | Gross Density kg/dm³ | Elmendorf Longit. mN | Elmendorf Transv. mN | Cobb-Riz. DS g/m² | IGT DS 1000/mm | Air Permeability cm³/min | Transparency % | Smoothness DS Bekk sek |
|---|---|---|---|---|---|---|---|---|---|
| | | | Influence of the Moist Glaze Finishing Paper Without Coating | | | | | | |
| | | | | A. Roller Temperature 110° C. | | | | | |
| 1 | 70.5 ± 1.16 | 1.085 | 353 ± 4 | 445 ± 15 | 4.7 ± 0.04 | 10.4 ± 0.1 | 2.9 ± 0.1 | 44.3 ± 0.1 | 965 ± 176 |
| 2 | 68.6 ± 0.64 | 0.902 | 383 ± 36 | 449 ± 0 | 7.7 ± 0.09 | 14.4 ± 0.9 | 7.8 ± 0.5 | 42.8 ± 0.7 | 154 ± 19 |
| 3 | 69.0 ± 1.99 | 0.959 | 378 ± 6 | 432 ± 4 | 9.2 ± 0.12 | 12.8 ± 0.2 | 9.6 ± 0.7 | 35.9 ± 0.8 | 427 ± 24 |
| 4 | 73.0 ± 0.99 | 1.059 | 330 ± 0 | 403 ± 8 | 3.5 ± 0.21 | 8.1 ± 0.2 | 1.1 ± 0.1 | 40.7 ± 0.9 | 3126 ± 304 |
| 5 | 70.6 ± 1.31 | 1.024 | 323 ± 8 | 390 ± 13 | 3.6 ± 0.09 | 9.1 ± 0.2 | 1.2 ± 0.1 | 41.5 ± 1.5 | 2431 ± 430 |
| | | | | B. Roller Temperature 140° C. | | | | | |
| 1 | 70.9 ± 0.05 | 1.058 | 416 ± 42 | 442 ± 8 | 4.6 ± 0.11 | 10.2 ± 0.3 | 2.4 ± 0.2 | 46.5 ± 1.0 | 904 ± 71 |
| 2 | 68.7 ± 0.63 | 0.915 | 386 ± 21 | 450 ± 8 | 6.1 ± 0.08 | 12.5 ± 0.1 | 5.0 ± 0.1 | 46.5 ± 0.5 | 182 ± 14 |
| 3 | 70.1 ± 0.73 | 0.959 | 393 ± 3 | 442 ± 11 | 6.3 ± 0.12 | 11.5 ± 0.6 | 5.2 ± 0.7 | 40.1 ± 0.8 | 554 ± 73 |
| 4 | 73.6 ± 1.01 | 1.067 | 341 ± 18 | 396 ± 3 | 2.4 ± 0.09 | 7.7 ± 0.1 | 0.6 ± 0.03 | 49.1 ± 1.5 | 2816 ± 345 |
| 5 | 71.5 ± 0.37 | 1.066 | 343 ± 11 | 373 ± 8 | 2.9 ± 0.10 | 8.1 ± 0.1 | 0.7 ± 0.10 | 47.1 ± 1.0 | 1878 ± 46 |

Designation of Samples:
1 = base sample
2 = Creslan 98
3 = Creslan 93
4 = UL 410
5 = E 790

TABLE 4

| SMPL | Surface Weight g/m² | Gross Density kg/dm³ | Elmendorf Longit. mN | Elmendorf Transv. mN | Cobb-Riz. DS g/m² | IGT DS 1000/mm | Air Permeability cm³/min | Transparency % | Smoothness DS Bekk sek |
|---|---|---|---|---|---|---|---|---|---|
| | | | Influence of the Dry Glaze Finishing Paper With Coating | | | | | | |
| | | | | A. Roller Temperature 110° C. | | | | | |
| 1 | 70.8 ± 0.57 | 0.998 | 390 ± 5 | 398 ± 3 | 4.0 ± 0.05 | 12.6 ± 0.3 | 1.3 ± 0.7 | 40.2 ± 0.06 | 560 ± 34 |
| 2 | 70.1 ± 0.96 | 0.845 | 404 ± 35 | 447 ± 11 | 7.0 ± 0.11 | 16.6 ± 1.5 | 5.0 ± 0.3 | 39.5 ± 0.4 | 101 ± 14 |
| 3 | 72.0 ± 0.88 | 0.867 | 403 ± 8 | 444 ± 13 | 7.7 ± 0.21 | 15.7 ± 0.2 | 4.7 ± 0.4 | 33.6 ± 0.7 | 263 ± 24 |
| 4 | 74.2 ± 1.16 | 1.003 | 336 ± 4 | 404 ± 5 | 3.0 ± 0.07 | 9.9 ± 0.4 | <0.45 | 33.0 ± 1.5 | 2335 ± 70 |
| 5 | 73.4 ± 0.8 | 0.991 | 370 ± 47 | 418 ± 6 | 2.8 ± 0.22 | 10.7 ± 0.1 | <0.45 | 34.6 ± 0.9 | 1348 ± 321 |
| | | | | B. Roller Temperature 140° C. | | | | | |
| 1 | 71.4 ± 0.35 | 1.02 | 379 ± 14 | 400 ± 9 | 3.4 ± 0.19 | 11.6 ± 0.3 | 1.5 ± 0.2 | 41.5 ± 0.5 | 716 ± 61 |
| 2 | 70.4 ± 0.61 | 0.891 | 376 ± 8 | 414 ± 6 | 4.9 ± 0.11 | 14.4 ± 0.5 | 3.5 ± 0.3 | 42.7 ± 0.4 | 168 ± 10 |
| 3 | 71.7 ± 0.08 | 0.907 | 378 ± 11 | 406 ± 6 | 4.9 ± 0.31 | 12.5 ± 0.5 | 2.8 ± 0.4 | 37.5 ± 1.3 | 426 ± 76 |
| 4 | 74.6 ± 1.05 | 1.022 | 383 ± 16 | 385 ± 0 | 1.8 ± 0.07 | 8.5 ± 0.3 | <0.45 | 40.0 ± 1.5 | 1919 ± 42 |
| 5 | 73.5 ± 0.68 | 1.007 | 334 ± 6 | 376 ± 4 | 1.8 ± 0.15 | 9.2 ± 0.1 | <0.45 | 41.3 ± 1.3 | 1915 ± 11 |

Designation of Samples:
1 = base samples
2 = Creslan 98
3 = Creslan 93
4 = UL 410
5 = E 790

TABLE 5

| SMPL | Surface Weight g/m² | Gross Density kg/dm³ | Elmendorf Longit. mN | Elmendorf Transv. mN | Cobb-Riz. DS g/m² | IGT DS 1000/mm | Air Permeability cm³/min | Transparency % | Smoothness DS Bekk sek |
|---|---|---|---|---|---|---|---|---|---|
| | | | Influence of the Moist Glaze Finishing Paper With Coating | | | | | | |
| | | | | A. Roller Temperature 110° C. | | | | | |

TABLE 5-continued

| SMPL | Surface Weight g/m² | Gross Density kg/dm³ | Elmendorf Longit. mN | Elmendorf Transv. mN | Cobb-Riz. DS g/m² | IGT DS 1000/mm | Air Permeability cm³/min | Transparency % | Smoothness DS Bekk sek |
|---|---|---|---|---|---|---|---|---|---|
| Influence of the Moist Glaze Finishing Paper With Coating | | | | | | | | | |
| 1 | 71.9 ± 0.91 | 1.123 | 360 ± 5 | 414 ± 5 | 2.3 ± 0.10 | 9.8 ± 0.6 | 0.61 ± 0.04 | 44.6 ± 0.8 | 916 ± 116 |
| 2 | 70.8 ± 0.66 | 0.908 | 391 ± 6 | 450 ± 13 | 3.7 ± 0.02 | 13.4 ± 0.5 | 2.4 ± 0.3 | 43.1 ± 0.8 | 147 ± 33 |
| 3 | 71.7 ± 0.36 | 0.982 | 398 ± 14 | 437 ± 21 | 4.2 ± 0.26 | 11.2 ± 0.3 | 2.0 ± 0.3 | 37.3 ± 1.7 | 491 ± 64 |
| 4 | 74.9 ± 0.9 | 1.055 | 343 ± 4 | 423 ± 8 | 1.6 ± 0.08 | 7.5 ± 0.1 | <0.45 | 38.5 ± 0.7 | 3883 ± 327 |
| 5 | 73.6 ± 0.67 | 1.051 | 338 ± 8 | 408 ± 3 | 1.7 ± 0.06 | 7.9 ± 0.1 | <0.45 | 40.7 ± 1.4 | 2105 ± 415 |
| B. Roller Temperature 140° C. | | | | | | | | | |
| 1 | 72.2 ± 0.31 | 1.128 | 345 ± 0 | 408 ± 10 | 1.9 ± 0.05 | 9.2 ± 0.2 | <0.45 | 49.4 ± 0.8 | 951 ± 40 |
| 2 | 71.5 ± 0.35 | 0.979 | 370 ± 10 | 440 ± 4 | 2.7 ± 0.07 | 11.7 ± 0.1 | 1.0 ± 0.1 | 48.8 ± 0.8 | 198 ± 18 |
| 3 | 71.6 ± 1.34 | 0.995 | 380 ± 10 | 432 ± 8 | 2.6 ± 0.14 | 10.5 ± 0.2 | 0.8 ± 0.2 | 44.1 ± 1.3 | 689 ± 82 |
| 4 | 74.7 ± 0.50 | 1.083 | 321 ± 4 | 394 ± 9 | 1.2 ± 0.07 | 7.7 ± 0.2 | <0.45 | 46.8 ± 1.4 | 3095 ± 504 |
| 5 | 73.5 ± 0.16 | 1.081 | 343 ± 6 | 409 ± 5 | 1.3 ± 0.02 | 7.9 ± 0.2 | <0.45 | 48.4 ± 1.1 | 2453 ± 366 |

Designation of Samples:
1 = base sample
2 = Creslan 98
3 = Creslan 93
4 = UL 410
5 = E 790

TABLE 6

| Sample | | Cobb-Riz. DS g/m² | Air permeability cm³/min | Smoothness DS Bekk sek |
|---|---|---|---|---|
| Paper Characteristic After Successive Moist and Dry Glaze Finishing | | | | |
| 4 | a | 1.20 | <0.45 | about 3100 |
| | b | 0.22 | <<0.45 | 960 |
| 5 | a | 1.30 | <0.45 | about 2450 |
| | b | 0.32 | <<0.45 | 1080 |

a - See Example 1, Table 5 (Moist glaze finishing, 140° C.)
b - Combination of moist and dry glaze finishing in accordance with Example 2

TABLE 7

| Sample | Glaze finishing | SCAN porosity cm³/m²s | Transparency % | Smoothness DS Bekk, s | Cobb-Riz. DS g/m² |
|---|---|---|---|---|---|
| Paper Characteristics After Dry or Moist Glaze Finishing With Constant Roller Temperature (130° C.) | | | | | |
| 6 | 1 | 256 | 43.4 | 1070 | 1.71 |
| (4 mm) | 2 | 107 | 49.4 | 1277 | n.m |
| 7 | 1 | 1125 | 38.2 | 816 | 4.11 |
| (6 mm) | 2 | 368 | 46.9 | 1697 | n.m |
| Base | 1 | 559 | 38.3 | 1106 | 3.2 |
| Sample | 2 | 86 | 47.3 | 1410 | n.m |

1 - Dry glaze finishing
2 - Moist glaze finishing
n.m - Not measurable (sample too narrow)

We claim:

1. A process for the manufacture of highly compressed paper having a high and uniform transparency of at least 35% and a high smoothness, and containing synthetic fibers with a volume weight of equal to or greater than 0.9 kg/dm³, comprising forming a paper sheet comprising a mixture of cellulose and thermoplastic synthetic fibers inn the ratio of about 50:50 to 90:10, having a degree of grinding of about 35 to 75 SR, and having one or more materials added to the paper sheet which is selected from the group consisting essentially of one or more of sizing, retention and wetting agents, and fillers;

applying a surface coating to said paper sheet comprising a surface sizing of a mixture of polyvinyl alcohol and carboxymethyl cellulose; and subsequently glaze finnish said surface sized paper sheet in a separate operational stage by subjecting said paper sheet to smooth calender rollers to compress said sheet, said calender rollers having a surface temperature of at least about 100° C. and linear roller pressures of at least about 30 kN/m.

2. The process of claim 1, wherein the cellulose comprises long and short fiber sulfate celluloses in the ratio of about 90:10 to 10:90.

3. The process of claim 1, wherein the thermoplastic synthetic fibers comprise polyethylene fibers from the group consisting of polyethylene homopolymers (HDPE) and copolymers (LLDPE), which fibers have been made hydrophilic and have a fiber length of between about 0.5 mm and 6mm.

4. The process of claim 3, wherein the fiber length is between about 0.5 mm and 4 mm.

5. The process of claim 1, wherein the thermoplastic synthetic fibers are ground together with the cellulose.

6. The process of claim 2, wherein the thermoplastic synthetic fibers are ground together with the cellulose.

7. The process of claim 3, wherein the thermoplastic synthetic fibers are ground together with the cellulose.

8. The process of claim 1, wherein the cellulose is ground and the thermoplastic synthetic fibers are subsequently added to the ground cellulose.

9. The process of claim 2, wherein the cellulose is ground and the thermoplastic synthetic fibers are subsequently added to the ground cellulose.

10. The process of claim 3, wherein the cellulose is ground and the thermoplastic synthetic fibers are subsequently added to the ground cellulose.

11. The process of claim 1, wherein said surface sizing is a film forming sizing which is selected from the group consisting of modified starches, carboxymethyl cellulose, polyvinyl alcohol, polymer dispersions and combinations thereof.

12. The process of claim 1, wherein said paper sheet in either a moist or dry state is compressed in a multiple roller glazing calender under a linear roller pressure of at least about 30 Kn/m, at temperatures of at least about 110° C., and to a volume weight of at least about 0.9 kg/dm³.

13. The process of claim 2, wherein said paper sheet in either a most or dry state is compressed in a multiple roller glazing calender under a linear roller pressure of at least about 30 Kn/m, at temperatures of at least about 110° C., and to a volume weight of at last about 0.9 kg/dm$^3$.

14. The process of claim 3, wherein said paper sheet in either a moist or dry state is compressed in a multiple roller glazing calender under a linear roller pressure of at least about 30 Kn/m, at temperatures of at least about 110° C., and to a volume weight of at least about 0.9 kg/dm$^3$.

15. The process of claim 4, wherein said paper sheet in either a moist or dry state is compressed in a multiple roller glazing calender under a linear roller pressure of at least about 30 Kn/m, at temperatures of at least about 110° C., and to a volume weight of at least about 0.9 kg/dm$^3$.

16. The process of claim 7, wherein said paper sheet in either a moist or dry state is compressed in a multiple roller glazing calender under a linear roller pressure of at least about 30 Kn/m, at temperatures of at least about 110° C., and to a volume weight of at least about 0.9 kg/dm$^3$.

17. The process of claim 1, wherein said surface sizing is approximately a 3.5% sizing solution in which said polyvinyl alcohol comprises about 80% and said carboxymethyl cellulose comprises about 20%.

18. The process of claim 1, wherein said paper sheet is compressed in the dry state.

19. The process of claim 12, wherein said paper sheet is compressed in the dry state.

20. The process of claim 13, wherein said paper sheet is compressed in the dry state.

21. The process of claim 14, wherein said paper sheet is compressed in the dry state.

22. The process of claim 15, wherein said paper sheet is compressed in the dry state.

23. The process of claim 16, wherein said paper sheet is compressed in the dry state.

* * * * *